US011395978B1

(12) United States Patent
Kushner

(10) Patent No.: US 11,395,978 B1
(45) Date of Patent: Jul. 26, 2022

(54) PROJECTILE LAUNCHING DEVICES, ASSEMBLIES, AND RELATED METHODS

(71) Applicant: UT Brands LLC, San Diego, CA (US)

(72) Inventor: Robert Kushner, San Diego, CA (US)

(73) Assignee: UT BRANDS LLC, San Diego, CA (US)

( * ) Notice: Subject to any disclaimer, the term of this patent is extended or adjusted under 35 U.S.C. 154(b) by 0 days.

(21) Appl. No.: 17/689,786

(22) Filed: Mar. 8, 2022

(51) Int. Cl.
*F41B 3/02* (2006.01)
*F41B 5/00* (2006.01)
*A63H 33/18* (2006.01)

(52) U.S. Cl.
CPC ..... *A63H 33/18* (2013.01); *F41B 5/0094* (2013.01)

(58) Field of Classification Search
CPC ..... A63H 33/18; F41B 3/02; F41B 5/0094; F41B 7/08
USPC ..... 124/17, 20.1, 20.3
See application file for complete search history.

(56) References Cited

U.S. PATENT DOCUMENTS 2,026,199 A * 12/1935 Virneburg ..... F41B 3/02 124/20.3
2,808,043 A * 10/1957 Lombard ..... A01K 89/08 242/224
2,820,444 A * 1/1958 Pedersen ..... F41B 3/02 124/80
2,825,323 A * 3/1958 Huszar ..... F41B 3/02 24/265 R
2,948,078 A * 8/1960 Miotke ..... A01K 91/02 124/16
4,050,439 A * 9/1977 Rudy ..... F41B 3/02 124/16
4,722,316 A * 2/1988 Stinnett ..... F41B 3/02 124/16
5,190,021 A * 3/1993 Hull ..... F41B 3/02 124/35.1
5,247,920 A * 9/1993 Harbin ..... F41B 5/0094 124/44.6
5,579,749 A * 12/1996 Wilkinson ..... F41B 3/005 124/16
5,632,262 A * 5/1997 Hanson ..... F41B 5/123 124/20.1
5,694,913 A * 12/1997 Parrott ..... F41B 3/02 124/35.1
5,996,565 A * 12/1999 Whitmer ..... F41B 3/02 124/17
6,904,901 B2 6/2005 Mitchell
8,012,049 B1 * 9/2011 Walterscheid ..... F42B 6/003 473/578

(Continued)

*Primary Examiner* — Alexander R Niconovich
(74) *Attorney, Agent, or Firm* — Umberg Zipser LLP

(57) ABSTRACT

Devices, assemblies and methods are described for launching a projectile. A launching device includes a support extending along a first plane and having an outward surface and an inward surface spaced from the outward surface, the inward surface defining a space. The launching device further includes first and second elastic members extending between opposing first and second elastic member ends, respectively. The first and second elastic member ends are coupled to the support with the first elastic member ends spaced from each other and the second elastic member ends spaced from each other. The launching device further includes a handle grip coupled to the support and extending along a second plane perpendicular to the first plane.

20 Claims, 10 Drawing Sheets

(56) References Cited

U.S. PATENT DOCUMENTS

| | | | | |
|---|---|---|---|---|
| 8,087,405 | B2 * | 1/2012 | Mitchell | F41B 11/646 124/66 |
| 8,348,789 | B1 * | 1/2013 | Walterscheid | F42B 6/003 473/578 |
| 8,485,168 | B2 * | 7/2013 | Walterscheid | F41B 3/02 124/20.1 |
| 8,662,060 | B2 * | 3/2014 | Walterscheid | F41B 5/0094 124/20.3 |
| 8,689,773 | B2 * | 4/2014 | Walterscheid | F41B 5/12 124/23.1 |
| 8,991,373 | B2 * | 3/2015 | Cummings | F41B 7/08 124/20.3 |
| 9,091,514 | B1 * | 7/2015 | Cummings | F42B 12/382 |
| 9,097,483 | B2 * | 8/2015 | Walterscheid | F41B 3/02 |
| D738,440 | S | 9/2015 | Cummings | |
| 9,151,566 | B2 * | 10/2015 | Cummings | F41B 5/1484 |
| 9,239,205 | B2 * | 1/2016 | Cummings | F41B 7/08 |
| 9,310,171 | B2 * | 4/2016 | Cummings | A63H 27/14 |
| 9,341,448 | B2 * | 5/2016 | Cummings | F42B 6/06 |
| 9,395,141 | B2 * | 7/2016 | Cummings | F41B 5/1411 |
| 9,476,666 | B1 * | 10/2016 | Larner | F41B 5/00 |
| 9,522,321 | B2 * | 12/2016 | Cummings | F41B 7/08 |
| 9,784,522 | B1 * | 10/2017 | Cummings | F41B 5/0094 |
| 9,903,681 | B2 | 2/2018 | Walterscheid et al. | |
| 9,915,493 | B2 * | 3/2018 | Becker | F41B 3/02 |
| 9,927,203 | B1 * | 3/2018 | Shapiro | F41B 3/02 |
| 2010/0263649 | A1 * | 10/2010 | Fields | F42B 6/04 473/578 |
| 2012/0037137 | A1 * | 2/2012 | Thurmon | F41B 3/02 124/20.3 |
| 2013/0263838 | A1 * | 10/2013 | Cummings | F41B 5/0094 124/17 |
| 2015/0119174 | A1 * | 4/2015 | Cummings | A63H 33/18 473/585 |
| 2015/0136102 | A1 * | 5/2015 | Rieke | F41B 3/02 124/17 |
| 2015/0260478 | A1 * | 9/2015 | Park | F41B 3/005 124/20.3 |
| 2016/0153738 | A1 * | 6/2016 | Cummings | F41B 5/0094 124/20.3 |
| 2017/0045326 | A1 * | 2/2017 | Walterscheid | A63H 33/18 |

* cited by examiner

PROJECTILE LAUNCHING DEVICES, ASSEMBLIES, AND RELATED METHODS

FIELD OF THE INVENTION

The field of the invention is projectile launchers.

BACKGROUND

The following description includes information that may be useful in understanding the present invention. It is not an admission that any of the information provided herein is prior art or relevant to the presently claimed invention, or that any publication specifically or implicitly referenced is prior art.

Various devices exist for launching projectiles including slingshots, pump, or air-powered systems, and so forth. However, such systems can be difficult to use for younger users who may not have the hand-strength or body weight to properly launch a projectile.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for innovative projectile launching systems and methods that utilize a combination of strength and weight of a user to launch a projectile efficiently.

BRIEF SUMMARY OF THE INVENTION

A launching device for a projectile is provided. The launching device includes a support extending along a first plane and having an outward surface and an inward surface spaced from the outward surface. The inward surface defines a space. The launching device further includes a first elastic member extending between opposing first elastic member ends. The first elastic member ends are coupled to the support with the first elastic member ends spaced from each other. The first elastic member has a first elastic member midpoint positioned equidistant from the support between the first elastic member ends. The launching device further includes a second elastic member extending between opposing second elastic member ends. The second elastic member ends are coupled to the support with the second elastic member ends spaced from each other. The second elastic member has a second elastic member midpoint positioned equidistant from the support between the second elastic member ends. The launching device further includes a handle grip coupled to the support and extending along a second plane perpendicular to the first plane. A central point of the support is defined between the midpoints of the first and second elastic members. The central point of the support is substantially aligned with the second plane.

A launching assembly for a projectile is also provided. The launching assembly includes a support extending along a first plane and having an outward surface and an inward surface spaced from the outward surface. The inward surface defines a space. The launching assembly further includes a first elastic member extending between opposing first elastic member ends. The first elastic member ends are coupled to the support with the first elastic member ends spaced from each other. The launching device further includes a second elastic member extending between opposing second elastic member ends. The second elastic member ends are coupled to the support with the second elastic member ends spaced from each other. The launching assembly further includes a handle grip coupled to the support and extending along a second plane perpendicular to the first plane. The launching assembly further includes a first arm coupled to the support opposite the handle grip and extending along the second plane. The launching assembly further includes a second arm coupled to the handle group opposite the support and extending along the second plane.

Various objects, features, aspects, and advantages of the inventive subject matter will become more apparent from the following detailed description of preferred embodiments, along with the accompanying drawing figures in which like numerals represent like components.

DETAILED DESCRIPTION

Figure 1:
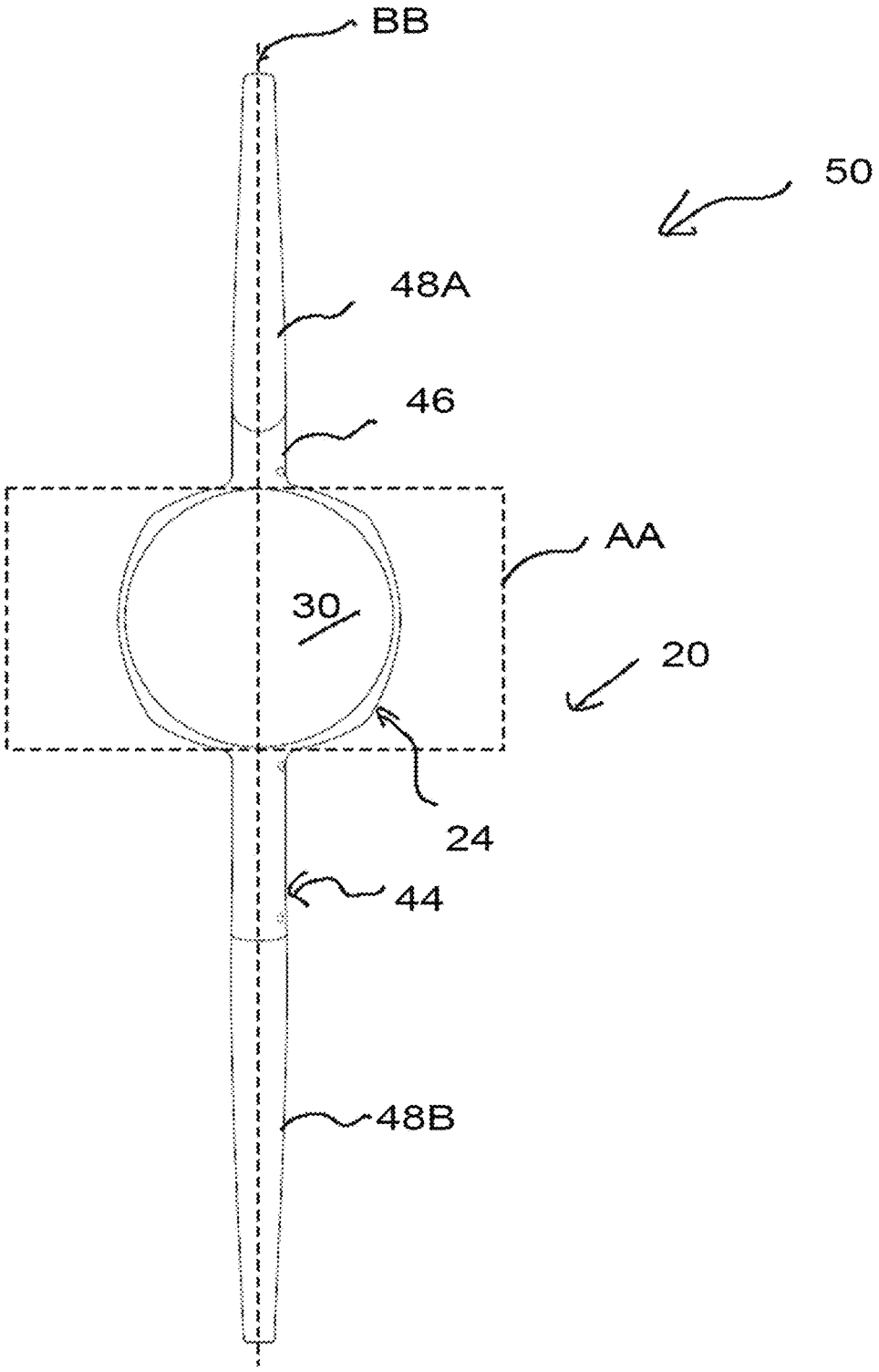
FIG. 1 is a front view illustrating non-limiting embodiments of a launching assembly including a launching device.
Figure 2:
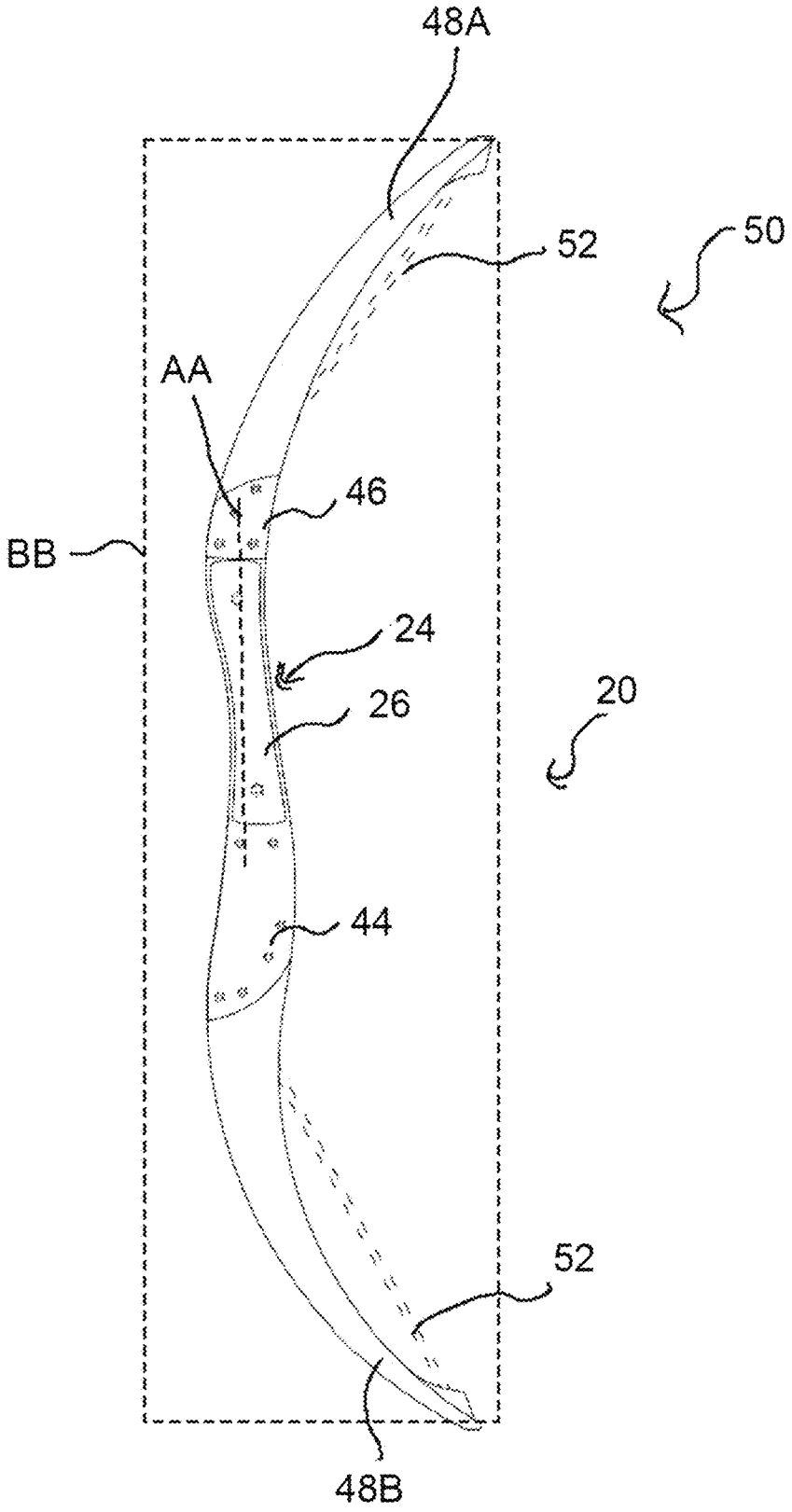
FIG. 2 is a side view illustrating non-limiting embodiments of the launching assembly of FIG. 1.
Figure 3:
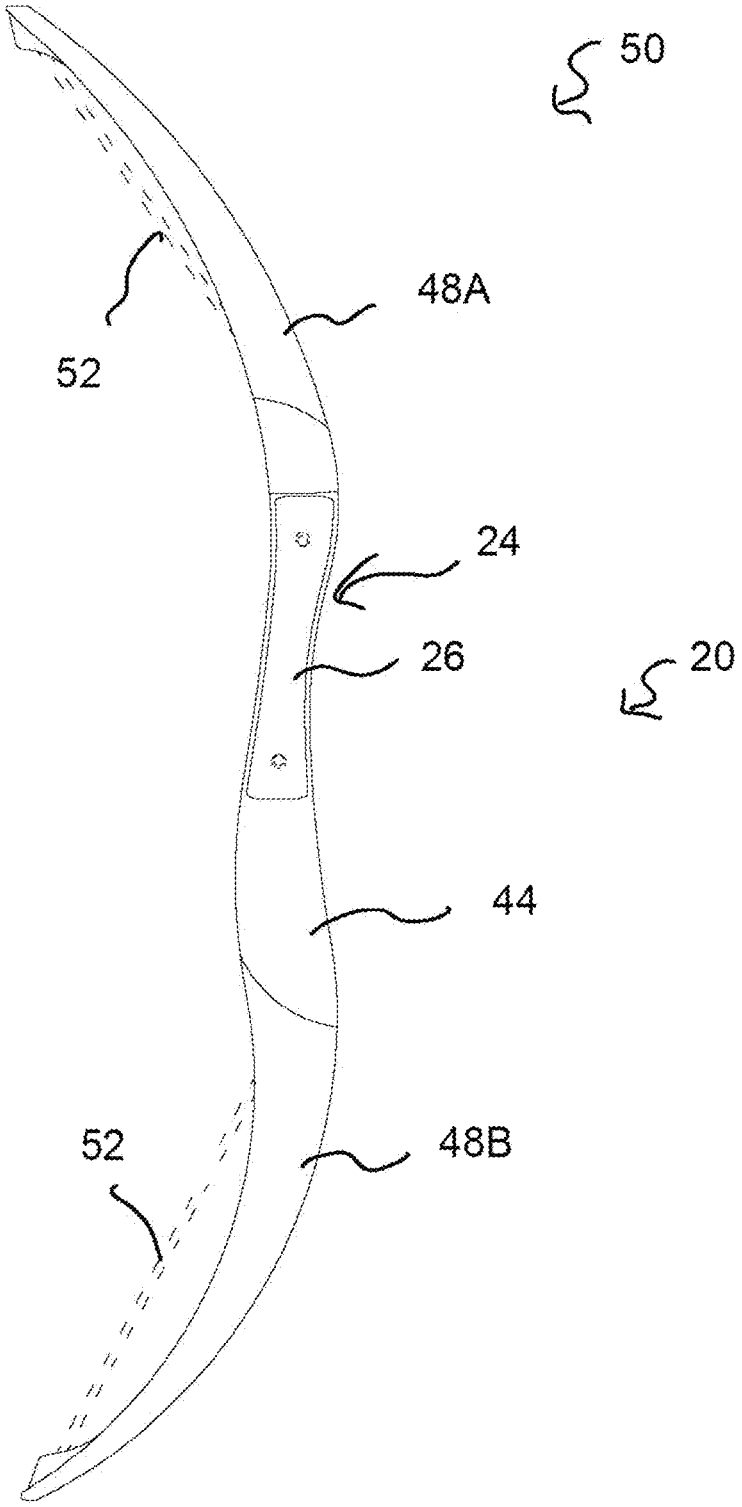
FIG. 3 is another side view illustrating non-limiting embodiments of the launching assembly of FIG. 1.
Figure 4:
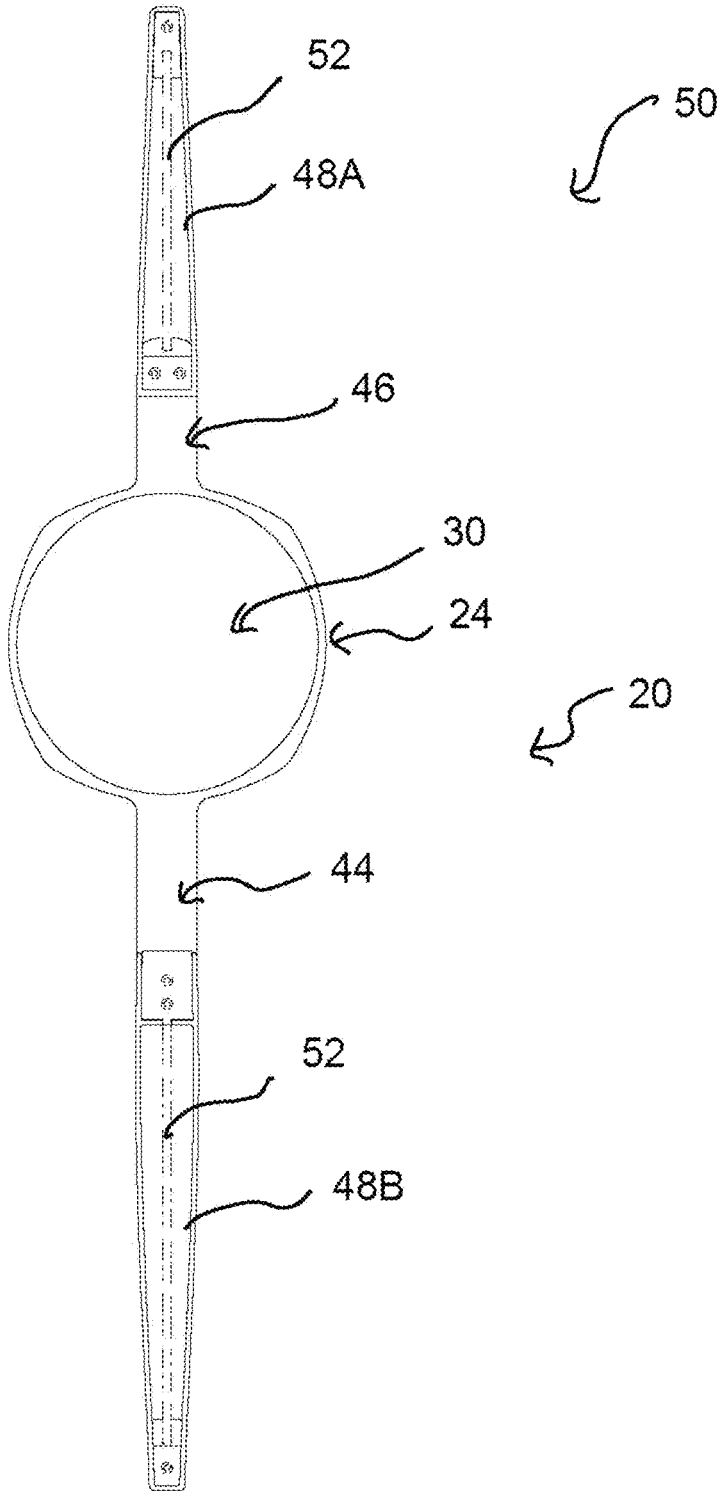
FIG. 4 is a rear view illustrating non-limiting embodiments of the launching assembly of FIG. 1.
Figure 5:
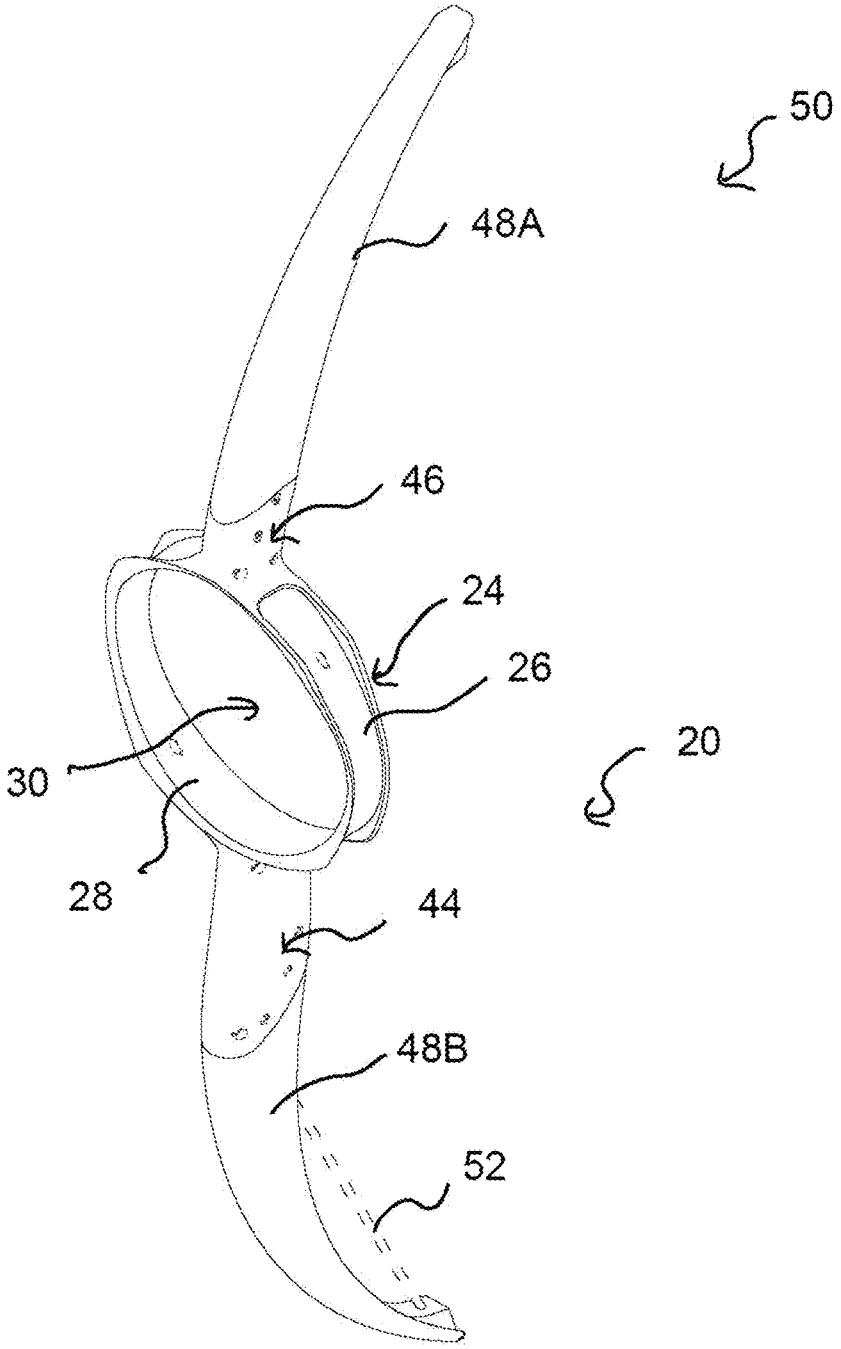
FIG. 5 is a perspective view illustrating non-limiting embodiments of the launching assembly of FIG. 1.
Figure 6:
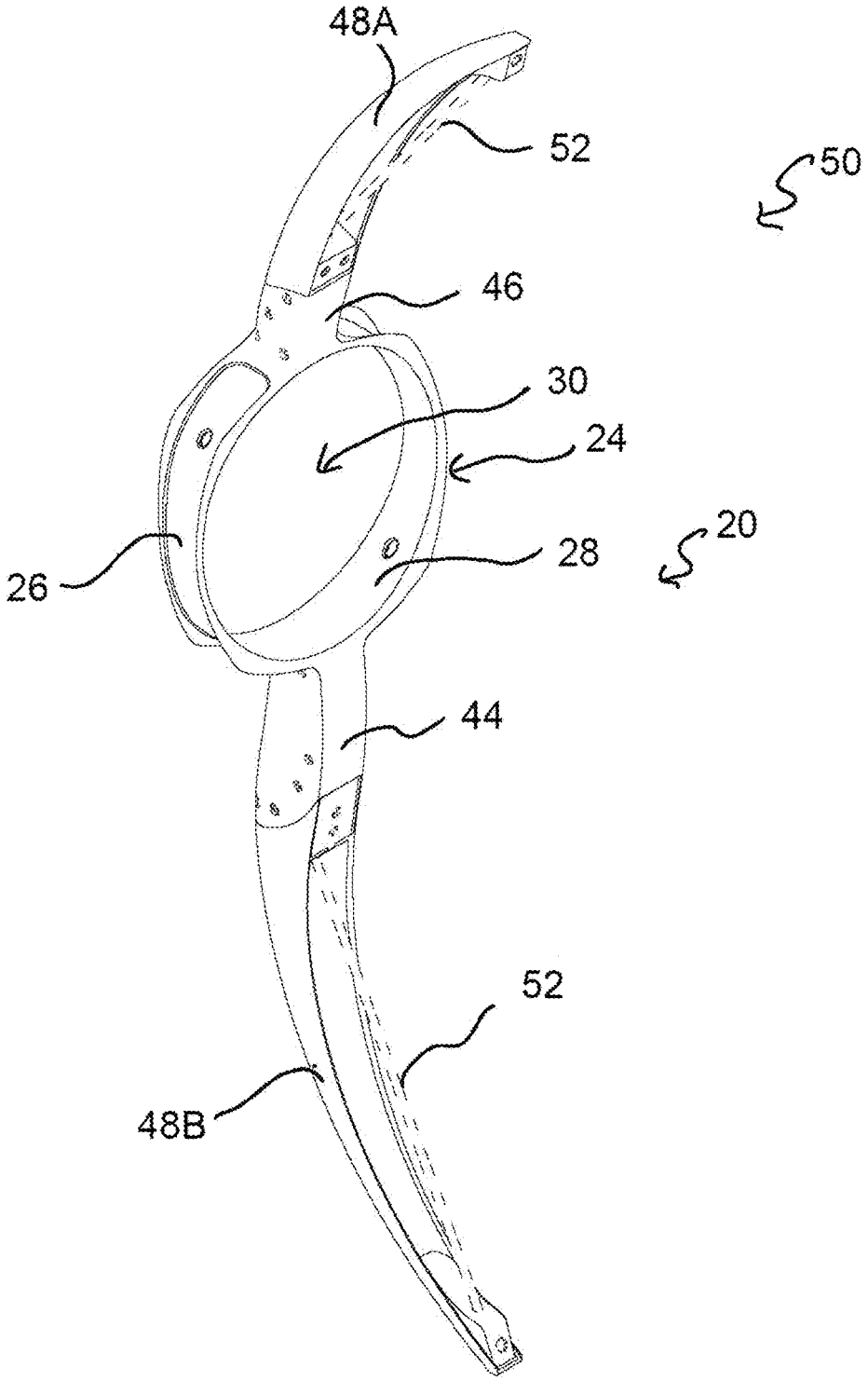
FIG. 6 is another perspective view illustrating non-limiting embodiments of the launching assembly of FIG. 1.

Except in the examples, or where otherwise expressly indicated, all numerical quantities in this description indicating amounts of material or conditions of reaction and/or use are to be understood as modified by the word "about" in describing the broadest scope of the disclosure. In various embodiments, the terms "about" and "approximately", when referring to a specified, measurable value (such as a parameter, an amount, a temporal duration, and the like), is meant to encompass the specified value and variations of and from the specified value, such as variations of +/−10% or less, alternatively +/−5% or less, alternatively +/−1% or less, alternatively +/−0.1% or less of and from the specified value, insofar as such variations are appropriate to perform in the disclosed embodiments. Thus the value to which the modifier "about" or "approximately" refers is itself also specifically disclosed.

Practice within the numerical limits stated is generally preferred. Also, unless expressly stated to the contrary: percent, "parts of," and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It must also be noted that, as used in the specification and the appended claims, the singular form "a," "an," and "the" comprise plural referents unless the context clearly indicates otherwise. For example, reference to a component in the singular is intended to comprise a plurality of components.

As used herein, an "embodiment" means that a particular feature, structure or characteristic is included in at least one or more manifestations, examples, or implementations of this invention. Furthermore, the particular features, structures or characteristics may be combined in any suitable manner, as would be apparent to a person skilled in the art. Combinations of features of different embodiments are all meant to be within the scope of the invention, without the need for explicitly describing every possible permutation by example. Thus, any of the claimed embodiments can be used in any combination.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed so as to have the same overall result as if the object were completely enclosed.

The drawings are semi-diagrammatic and not to scale and, particularly, some of the dimensions are for the clarity of presentation and are shown exaggerated in the drawings. Similarly, although the views in the drawings for ease of description generally show similar orientations, this depiction in the drawings is arbitrary. Generally, composite articles can be operated in any orientation. As used herein, it will be understood that when a first element or layer is referred to as being "over," "overlying," "under," or "underlying" a second element or layer, the first element or layer may be directly on the second element or layer, or intervening elements or layers may be present where a straight line can be drawn through and between features in overlying relationship. When a first element or layer is referred to as being "on" a second element or layer, the first element or layer is directly on and in contact with the second element or layer. Further, spatially relative terms, such as "upper," "over," "lower," "under," and the like, may be used herein for ease of description to describe one element or feature's relationship to another element(s) or feature(s) as illustrated in the figures. It will be understood that the spatially relative terms are intended to encompass different orientations of the composite article in use or operation in addition to the orientation depicted in the figures. For example, if the composite article in the figures is turned over, elements described as being "under" other elements or features would then be oriented "above" the other elements or features. Thus, the exemplary term "under" can encompass either an orientation of above or below. The composite article may be otherwise oriented (rotated 90 degrees or at other orientations) and the spatially relative descriptors used herein may likewise be interpreted accordingly.

Throughout this disclosure, where publications are referenced, the disclosures of these publications in their entireties are hereby incorporated by reference into this disclosure to more fully describe the state of the art to which this disclosure pertains.

The following detailed description is merely illustrative in nature and is not intended to limit the embodiments of the subject matter or the application and uses of such embodiments. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed. Furthermore, there is no intention to be bound by any expressed or implied theory presented in the preceding technical field, background, brief summary or the following detailed description.

FIGS. 1-9 are various views illustrating non-limiting embodiments of a launching device 20 for a projectile 22. The launching device 20 includes a support 24 extending along a first plane AA. The phrase "extending along" as utilized herein with regard to the first plane AA means that the first plane AA may be defined by any two distal points of the support 24 such that the support 24 may be generally flat or arcuate. The support 24 may have any configuration known in the art (e.g., circular, semi-circular, rectangular, triangular, ovular, and the like). In various embodiments, the support 24 has a generally circular configuration.

The support 24 may be formed using any process known in the art. Exemplary processes include, but are not limited to, molding (e.g., blow molding, compression molding, and/or injection molding), ultrasonics, and the like. The support 24 may be formed from or include a foam, a plastic, rubber, a lignocellulosic material, or combinations thereof. Non-limiting examples of suitable materials used to form the support 24 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

The support 24 has an outward surface 26 and an inward surface 28 spaced from the outward surface 26. In various embodiments, the outward surface 26 is opposite the inward surface 28. The outward surface 26 and inward surface 28 are transverse to the first plane AA. In various embodiment, the outward surface 26 and inward surface 28 are perpendicular to the first plane AA. The inward surface 28 defines a space 30 for the projectile 22 to travel through such that the projectile 22 may travel perpendicular to the first plane AA.

Figure 7:
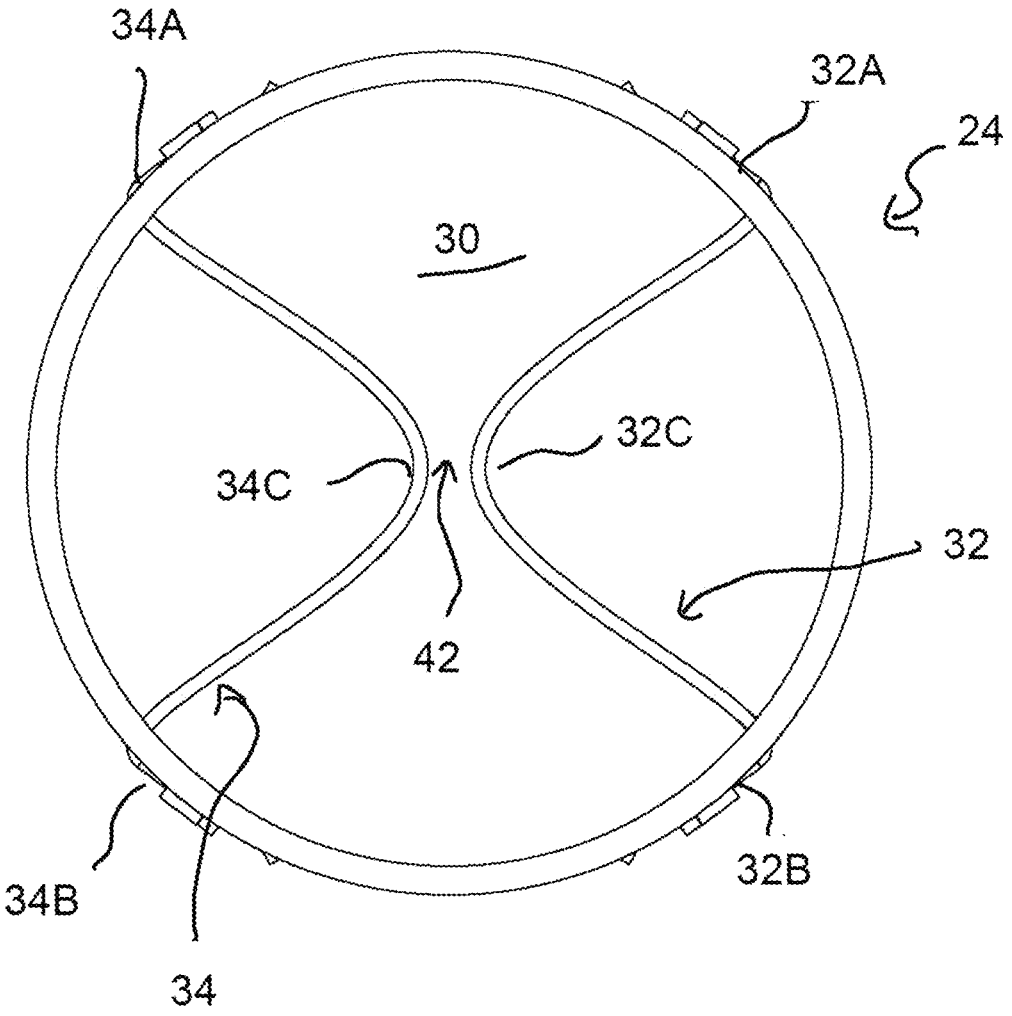
FIG. 7 is a front view illustrating non-limiting embodiments of a support of the launching device of FIG. 1.
Figure 8:
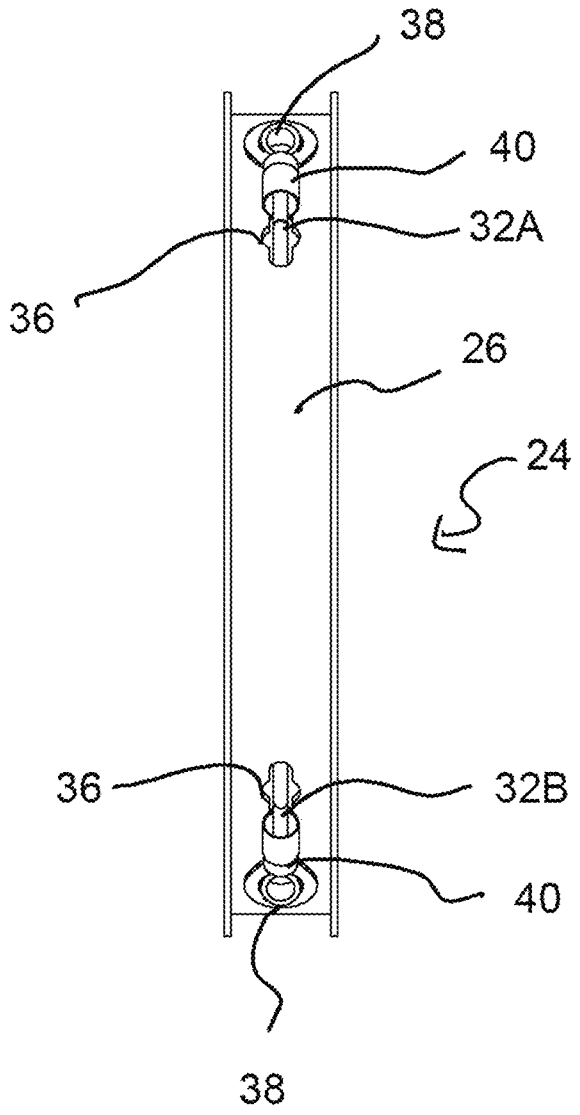
FIG. 8 is a side view illustrating non-limiting embodiments of the support of FIG. 7.
Figure 9:
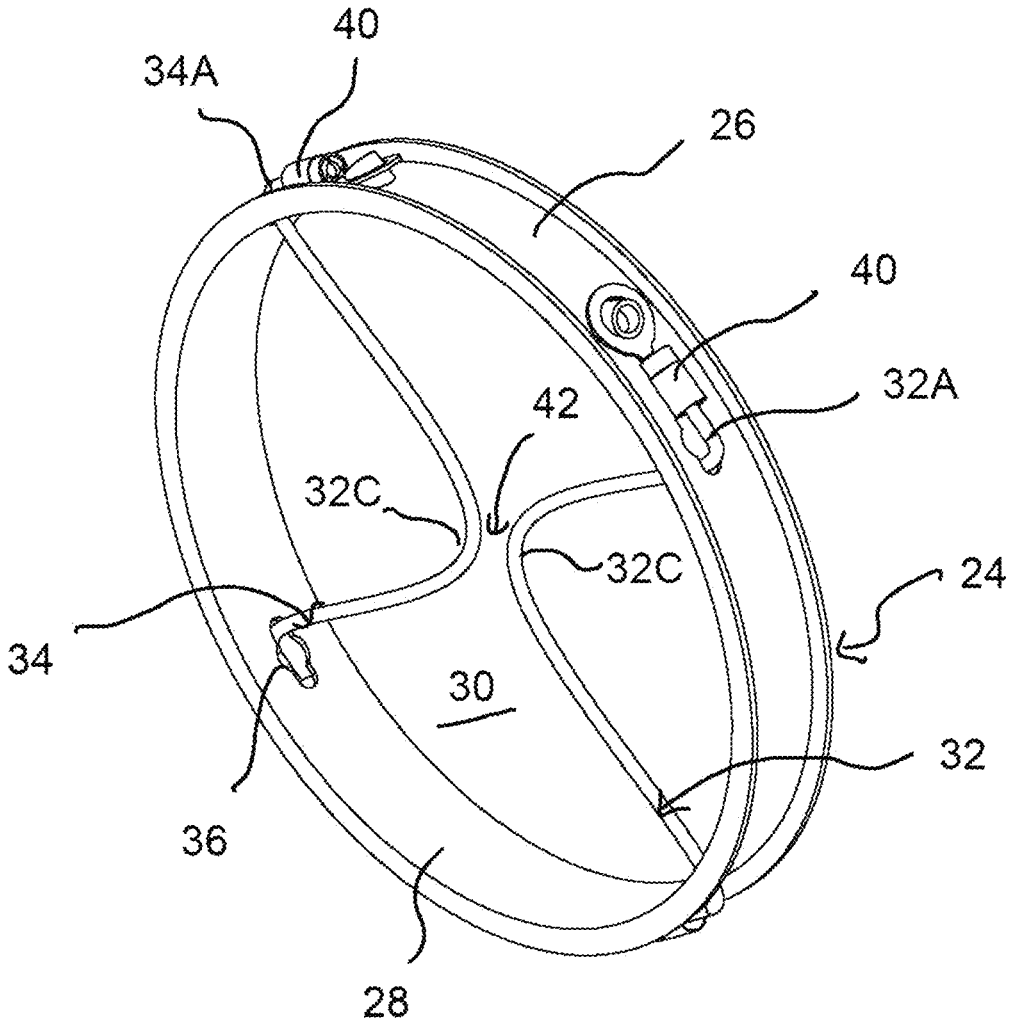
FIG. 9 is a perspective view illustrating non-limiting embodiments of the support of FIG. 7.

With particular reference to FIGS. 7-9, the launching device 20 further includes a first elastic member 32 and a second elastic member 34 coupled to the support 24. It is to be appreciated that FIGS. 7-9 illustrate a portion of the support 24 including the elastic members 32, 34, along with other elements, and thus FIGS. 1-6 are contemplated to include the elements shown in FIGS. 7-9. As used herein, the term "elastic" is defined to mean a length of the member can be increased at least 20% when sufficient force is applied based on the elastic modulus of the member, but the member will return to its initial length when the force is removed. It is to be appreciated that the launching device 20 may include more than two elastic members, such as 3, 4, 5, 6, 7, 8, 9, or 10 elastic members. The elastic members 32, 34 may be formed using any process known in the art. Exemplary processes include, but are not limited to, molding (e.g., blow molding, compression molding, and/or injection molding), ultrasonics, and the like. The elastic members 32, 34 may be formed from or include a plastic, rubber, or combinations thereof. Non-limiting examples of suitable materials used to form the elastic members 32, 34 include latex, polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

The first elastic member 32 extends between opposing first elastic member ends 32A, 32B. Likewise, the second elastic member 34 extends between opposing second elastic member ends 34A, 34B. The first elastic member ends 32A, 32B are coupled to the support 24 and are spaced from each other. Likewise, the first elastic member ends 34A, 34B are coupled to the support 24 and are spaced from each other. In other words, in various embodiments, the first and second elastic members 32, 34 do not have "closed" loop configurations because the first elastic member ends 32A, 32B are spaced from each other and the second elastic member ends 34A, 34B are spaced from each other. However, it is to be appreciated that one of the first elastic member ends 32A, 32B may be adjacent one of the second elastic member ends 34A, 34B. The inventors contemplate that usability and performance of the launching device 20 is improved by spacing the first elastic member ends 32A, 32B from each other and the second elastic member ends 34A, 34B from each other due to the increased area available to catch the first elastic member 32 by the projectile 22. Furthermore, by spacing the first elastic member ends 32A, 32B from each other and the second elastic member ends 34A, 34B from each other, longer first and second elastic members 32, 34 can be utilized thereby increasing the draw distance of the first and second elastic members 32, 34 during use of the launching device 20.

In certain embodiments, the support 34 defines a plurality of holes 36 between the outward and inward surfaces 26, 28. In these and other embodiments, the space 30 defined by the support 24 has four quadrants that are substantially equal in size to each other and each of the plurality of holes 36 are defined adjacent one of the quadrants. However, it is to be appreciated that the space 30 may be separated in any number depending on the number of elastic members utilized. Furthermore, the separation of the space 30 may not be equal.

Each of the first and second elastic member ends 32A, 32B, 34A, 34B may extend through one of the plurality of holes 36 and may be coupled to the outward surface 26 of the support 24. The first and second elastic member ends 32A, 32B, 34A, 34B may be coupled to the outward surface 26 of the support 24 by a fastener, an adhesive, a knot, or combinations thereof.

In some embodiments, the support 24 includes a plurality of nubs 38 with each nub 38 disposed adjacent one of the plurality of holes 36. Each of the first and second elastic member ends 32A, 32B, 34A, 34B may be coupled to one of the plurality of nubs 38. In exemplary embodiments, each of the first and second elastic member ends 32A, 32B, 34A, 34B include a fastener 40 coupled thereto. Any type of fastener may be utilized, such as nuts, bolts, screws, keys, washers, rivets, anchors, studs, inserts, rings, pins, or combinations thereof. In these and other embodiments, each of the fasteners 40 is removably coupled to one of the plurality of nubs 38. In exemplary embodiments, the fasteners 40 are ring terminal connector studs including a stud portion and a ring portion. The stud portion may be crimped onto the first and second elastic member ends 32A, 32B, 34A, 34B and the ring portion may be removably coupled to one of the plurality of nubs 38. A screw or clip may be used to secure the ring portion to the nub 38. The inventors contemplate that usability and performance of the launching device 20 is improved by utilizing fasteners 40 that are removably coupled to the support 24 due to ease of replacing the first and second elastic members 32, 34 should either fail.

In certain embodiments, each of the plurality of holes 36 has a large portion disposed between two small portions such that the fastener 40 is moveable through the plurality of holes 36 when the fastener 40 is in a first orientation and prevented from moving through the plurality of holes 36 when the fastener 40 is in a second orientation. The inventors contemplate that safety of the launching device 20 is improved should the fastener 40 disengage from the nub 38 by preventing movement of the fastener 40 through the hole 36 when the fastener 40 is in the second orientation thereby minimizing the occurrence of an elastic member from snapping back at the user.

In some embodiments, the first elastic member 32 has a first elastic member midpoint 32C positioned equidistant from the support 24 between the first elastic member ends 32A, 32B. Likewise, the second elastic member 34 has a second elastic member midpoint 34C positioned equidistant from the support 24 between the second elastic member ends 34A, 34B. In other words, the portion of the first elastic member 32 extending from the support 24 within the space 30 meet at the midpoint 32C. Likewise, the portion of the second elastic member 34 extending from the support 24 within the space 30 meet at the midpoint 34C. In these and other embodiments, a central point 42 of the support 24 is defined between the midpoints 32C, 34C of the first and second elastic members 32, 34, respectively. It is contemplated herein that the central point 42 is defined between the midpoints 32C, 34C of the first and second elastic members 32, 34 when the first and second elastic members 32, 34 are taut and oriented toward each other such that a gap remains between the midpoints 32C, 34C of the first and second elastic members 32, 34.

Referring back to FIGS. 1-6, the launching device 20 further includes a handle grip 44 coupled to the support 24. The handle grip 44 may have any configuration known in the art. In various embodiments, the handle grip 44 is adapted to be held by a hand of the user. The handle grip 44 may be formed using any process known in the art. Exemplary processes include, but are not limited to, molding (e.g., blow molding, compression molding, and/or injection molding), ultrasonics, and the like. The handle grip 44 may be formed from or include a foam, a plastic, rubber, a lignocellulosic material, or combinations thereof. Non-limiting examples of suitable materials used to form the handle grip 44 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof. In various embodiments, the support 24 and the handle grip 44 are formed as a unitary part. However, it is to be appreciated that the support 24 and the handle grip 44 may be formed as separate parts and each of the support 24 and the handle grip 44 may be formed of several pieces. Conventional methods and devices for fastening the parts and pieces may be utilized.

The handle grip 44 may extend along a second plane BB perpendicular to the first plane AA. The phrase "extend along" as utilized herein with regard to the second plane BB means that the second plane BB may be defined by any two distal points of the handle grip 44 such that the handle grip 44 may be generally flat or arcuate. The central point 42 of the support 24 may be substantially aligned with the second plane BB. The term "substantially" as utilized herein means that the central point 42 may be no greater than 10 cm, no greater than 5 cm, or no greater than 1 cm, off center from the second plane BB. The inventors contemplate that usability and performance of the launching device 20 is improved by substantially aligning the central point 42 with the second plane BB due to the alignment of the force generated by one hand of the user during draw of the elastic members 32, 34 and the force generated by the other hand of the user to hold the handle grip 44. The alignment of these forces minimizes twisting of the launching device 20 during draw that would result if the handle grip 44 was offset from central point 42 relative to the first plane AA.

The launching device 20 may further include an extension 46 coupled to the support 24 opposite the handle grip 44. The extension 46 may have any configuration known in the art. The extension 46 may extend along the second plane BB. The phrase "extend along" as utilized herein with regard to the second plane BB means that the second plane BB may be defined by any two distal points of the extension 46 such that the extension 46 may be generally flat or arcuate.

The extension 46 may be formed using any process known in the art. Exemplary processes include, but are not limited to, molding (e.g., blow molding, compression molding, and/or injection molding), ultrasonics, and the like. The extension 46 may be formed from or include a foam, a plastic, rubber, a lignocellulosic material, or combinations thereof. Non-limiting examples of suitable materials used to form the extension 46 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof. In various embodiments, the support 24, the handle grip 44, and the extension 46 are formed as a unitary part. However, it is to be appreciated that the support 24, the handle grip 44, and the extension 46 may be formed as separate parts and each of the support 24, the handle grip 44, the extension 46 may be formed of several pieces. Conventional methods and devices for fastening the parts and pieces may be utilized.

In various embodiments, at least one of the handle grip 44 and the extension 46 is configured to couple to an accessory 48. The accessory 48 may be selected from the group of an arm, a shield, a blade, an illumination device, a projectile holster, a sight, or combinations thereof. As shown in FIGS. 1-6, a first arm 48A is coupled to the extension 46 and a second arm 48B is coupled to the handle grip 44. However, it is to be appreciated that any combination of accessories 48 may be coupled to the launching device 20. In certain embodiments, the accessory 48 is configured to couple to another accessory 48. For example, a sight may be coupled to the extension 46 and an arm may be coupled to the sight. All other combinations of accessories 48 are contemplated herein.

FIGS. 1-9 are also various views illustrating non-limiting embodiments of a launching assembly 50 for a projectile 22. In various embodiments, the launching assembly 50 includes the launching device 20 along with the first arm 48A and the second arm 48B coupled thereto. In particular, the first arm 48A may be coupled to the support 24 opposite the handle grip 44 (e.g., to the extension 46) and extending along the second plane BB. The second arm 48B may be coupled to the handle grip 44 opposite the support 24 and extending along the second plane BB.

In various embodiments, the first and second elastic members 32, 34 are isolated from the first and second arms 48A, 48B. The term "isolated" as utilized herein means that draw of the first and second elastic members 32, 34 does not generate a force on the first and second arms 48A, 48B. In other words, the launching assembly 50 without the first and second arms 48A, 48B (i.e., the launching device 20) can be utilized to launch the projectile 22. At least one of the first and second arms 48A, 48B may have an arcuate configuration that is angled along the second plane BB. However, it is to be appreciated that the arms 48A, 48B may have any configuration. At least one of the first and second arms 48A, 48B includes an additional elastic member 52 coupled to distal ends of the first or second arm 48A, 48B, respectively. In various embodiments, the additional elastic member 52 is isolated from the first and second elastic members 32, 34. At least one of the first and second arms 48A, 48B may be removably coupled to the support 24 (e.g., removably coupled to the extension 46) or the handle grip 44, respectively. The inventors contemplate that usability of the launching assembly 50 is improved by isolating the first and second elastic members 32, 34 from the first and second arms 48A, 48B and removably coupling the first and second arms 48A, 48B to the launching assembly 50 due to the greater ease of assembling and disassembling the launching assembly 50.

Figure 10:
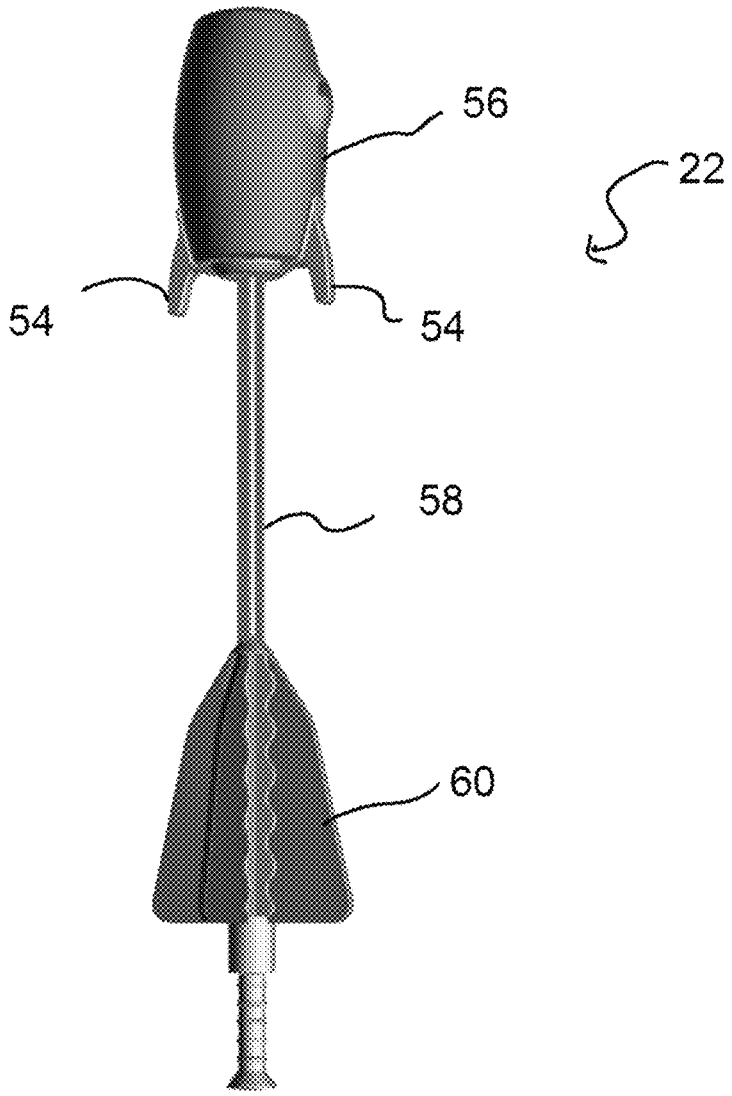
FIG. 10 is a perspective view illustrating non-limiting embodiments of a projectile.

FIG. 10 illustrates one embodiment of the projectile 22 for use with the launching device 20 or the launching assembly 50 described above. Non-limiting examples of suitable projectiles can be found in U.S. patent application Ser. No. 17/538,793 which is incorporated herein by reference in its entirety. The projectile 22 may include at least one projection 54 (e.g., two projections) extending outwardly from a surface of the projectile 52, where the projection 54 is sized and dimensioned to contact at least a portion of the first and second elastic members 32, 34. The projection 54 may include a hook, a noc, or other projection, or other means of capture, for example.

In some embodiments, the projectile 22 may comprise a head portion 56, a middle portion 58 and a tail portion 60, all connected or coupled together to form the projectile 22. The tail portion 60 may include a set of fins to stabilize the projectile 22 when moving through the air. Of course, different shapes, sizes and configurations of projectiles could be used with the launching device 20 or the launching assembly 50 without departing from the scope of the invention described herein, so long as the projectile 22 can removably couple to the first and second elastic members 32, 34 to launch the projectile 22 as discussed below.

As described above, the projectile 22 can be launched by the launching device 20 or the launching assembly 50 by connecting the projection 54 to the first and second elastic members 32, 34 and applying a pulling force by the user to the projectile 22 which causes the elastic members 32, 34 to extend in length (i.e. draw). Once the pulling force is removed from the projectile 22, stored kinetic energy retained in the elastic members 32, 34 causes an opposing force to the projectile 22, which causes the projectile 22 to move in a generally opposite direction as elastic members 32, 34 returns to its original length.

In another aspect, methods of instructing a user to launch the projectile 22 are also contemplated, especially those methods that utilize the device 20 or the assembly 50 described above and shown in FIGS. 1-9.

First, instructions can be provided that instruct the user or operator to hold the handle grip 44 with one hand and hold the projectile 22 with the other hand. Once the user is holding the handle grip 44 and the projectile 22, the user can be instructed to connect the projectile 22 to the elastic members 32, 34, such as by using the projection 54 of the projectile 22.

The user can then be instructed to pull the projectile 22 (and with it the elastic members) toward the user and then release the projectile 22 which transfers at least some of the elastic force to the projectile 22 to propel the projectile 22 in generally the opposite direction. To permit this to happen, the elastic members 32, 34 have an elasticity such that (i) when the projectile contacts at least the portion of the elastic members 32, 34 and a force is applied, a length of the elastic members 32, 34 increases and (ii) when the force is removed, the length of the elastic members 32, 34 decrease and a second force is applied to the projectile 22.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A launching device for a projectile comprising a projection, the launching device comprising:

a support extending along a first plane and having an outward surface and an inward surface spaced from the outward surface, the outward surface and inward surface transverse to the first plane, the inward surface defining a space;

a first elastic member extending between opposing first elastic member ends, the first elastic member ends coupled to the support with the first elastic member ends spaced from each other, the first elastic member having a first elastic member midpoint positioned equidistant from the support between the first elastic member ends;

a second elastic member extending between opposing second elastic member ends, the second elastic member ends coupled to the support with the second elastic member ends spaced from each other, the second elastic member having a second elastic member midpoint positioned equidistant from the support between the second elastic member ends; and a handle grip coupled to the support and extending along a second plane perpendicular to the first plane;

wherein a central point of the support is defined between the midpoints of the first and second elastic members;

wherein the central point of the support is substantially aligned with the second plane;

wherein the first and second elastic members are capable of cooperating with the projection of the projectile; and wherein each of the first and second elastic members are, independently, capable of increasing in length from an initial length to a drawn length in the presence of a force.

2. The launching device of claim 1, wherein the support defines a plurality of holes between the inward and outward surfaces, and wherein each of the first and second elastic member ends extend through one of the plurality of holes and are coupled to the outward surface of the support.

3. The launching device of claim 2, wherein the support comprises a plurality of nubs with each nub disposed adjacent one of the plurality of holes, and wherein each of the first and second elastic member ends are coupled to one of the plurality of nubs.

4. The launching device of claim 3, wherein each of the first and second elastic member ends comprise a fastener coupled thereto, and wherein each of the fasteners is removably coupled to one of the plurality of nubs.

5. The launching device of claim 4, wherein each of the plurality of holes has a large portion disposed between two small portions such that the fastener is moveable through the plurality of holes when the fastener is in a first orientation and prevented from moving through the plurality of holes when the fastener is in a second orientation.

6. The launching device of claim 2, wherein the space defined by the support has four quadrants that are substantially equal in size to each other, and wherein each of the plurality of holes are defined adjacent one of the quadrants.

7. The launching device of claim 1 further comprising an extension coupled to the support opposite the handle grip and extending along the second plane.

8. The launching device of claim 7, wherein at least one of the handle grip and the extension is configured to couple to an accessory.

9. The launching device of claim 8, wherein the accessory is selected from the group of an arm, a shield, a blade, an illumination device, a projectile holster, a sight, or combinations thereof.

10. The launching device of claim 1, wherein the support has a generally circular configuration.

11. A launching assembly for a projectile comprising a projection, the launching assembly comprising;

a support extending along a first plane and having an outward surface and an inward surface spaced from the outward surface, the inward surface defining a space;

a first elastic member extending between opposing first elastic member ends, the first elastic member ends coupled to the support with the first elastic member ends spaced from each other;

a second elastic member extending between opposing second elastic member ends, the second elastic member ends coupled to the support with the second elastic member ends spaced from each other;

a handle grip coupled to the support and extending along a second plane perpendicular to the first plane;

a first arm coupled to the support opposite the handle grip and extending along the second plane;

a second arm coupled to the handle grip opposite the support and extending along the second plane;

wherein each of the first and second elastic members are, independently, capable of increasing in length from an initial length to a drawn length in the presence of a force;

wherein the first and second elastic members are capable of cooperating with the projection of the projectile; and wherein each of the first and second elastic members are, independently, capable of increasing in length from an initial length to a drawn length in the presence of a force.

12. The launching assembly of claim 11, wherein the first and second elastic members are isolated from the first and second arms.

13. The launching assembly of claim 11, wherein at least one of the first and second arms has an arcuate configuration that is angled along the second plane.

14. The launching assembly of claim 11, wherein at least one of the first and second arms comprises an additional elastic member coupled to distal ends of the first or second arm, respectively.

15. The launching assembly of claim 11, wherein at least one of the first and second arms is removably coupled to the support or the handle grip, respectively.

16. The launching assembly of claim 15 further comprising an extension coupled to the support opposite the handle grip and extending along the second plane, wherein the first arm is removably coupled to the extension.

17. The launching assembly of claim 16, wherein at least one of the handle grip and the extension is configured to couple to an accessory.

18. The launching assembly of claim 17, wherein the accessory is selected from the group of a shield, a blade, an illumination device, a projectile holster, a sight, or combinations thereof.

19. The launching assembly of claim 11, wherein the support defines a plurality of holes between the inward and outward surfaces, and wherein each of the first and second elastic member ends extend through one of the plurality of holes and are coupled to the outward surface of the support.

20. The launching assembly of claim 19, wherein the space defined by the support has four quadrants that are substantially equal in size to each other, and wherein the each of the plurality of holes are defined adjacent one of the quadrants.

* * * * *